US011169486B2

(12) United States Patent
Kapetanovic et al.

(10) Patent No.: US 11,169,486 B2
(45) Date of Patent: Nov. 9, 2021

(54) CALENDAR MECHANISM FOR A TIMEPIECE

(71) Applicants: GFPI S.A., La Chaux-de-Fonds (CH); COMPLITIME SA, La Chaux-de-Fonds (CH)

(72) Inventors: Amel Kapetanovic, La Chaux-de-Fonds (CH); Adrian Stahel, Zurich (CH); Stephen Forsey, Les Brenets (CH); Christoph Neboisa, Schüpfen (CH)

(73) Assignees: GFPI S.A., La Chaux-de-Fonds (CH); COMPLITIME SA, La Chaux-de-Fonds (CH)

( * ) Notice: Subject to any disclaimer, the term of this patent is extended or adjusted under 35 U.S.C. 154(b) by 834 days.

(21) Appl. No.: 15/774,870

(22) PCT Filed: Nov. 11, 2016

(86) PCT No.: PCT/EP2016/077398
§ 371 (c)(1),
(2) Date: May 9, 2018

(87) PCT Pub. No.: WO2017/081231
PCT Pub. Date: May 18, 2017

(65) Prior Publication Data

US 2018/0335755 A1 Nov. 22, 2018

(30) Foreign Application Priority Data

Nov. 13, 2015 (CH) ..... 01656/15

(51) Int. Cl.
*G04B 19/253* (2006.01)
*G04B 19/26* (2006.01)

(52) U.S. Cl.
CPC ..... *G04B 19/2536* (2013.01); *G04B 19/2538* (2013.01); *G04B 19/26* (2013.01)

(58) Field of Classification Search
CPC ..... G04B 19/25333–25386
See application file for complete search history.

(56) References Cited

U.S. PATENT DOCUMENTS 30,166 A * 9/1860 Strode ..... G04B 19/2536 368/37
368,961 A * 8/1887 Morton ..... G04B 19/247 368/37

(Continued)

FOREIGN PATENT DOCUMENTS

CH 705737 5/2013
EP 0606576 7/1994

(Continued)

*Primary Examiner* — Daniel P Wicklund
(74) *Attorney, Agent, or Firm* — Duane Morris LLP; Gregory M. Lefkowitz

(57) ABSTRACT

A calendar mechanism for a timepiece suitable for indicating a piece of information having a period that varies according to at least a first cycle and a second cycle is provided. The mechanism, inter alia, is a system for actuating a lever, in which the actuating system includes a first feeler-spindle intended to come into contact with the first cam and a second feeler-spindle intended to come into contact with the second cam the feeler-spindles being kinematically linked with each other and the actuating system being arranged to move the lever from the inactive position to the active position under the control of each of the cams.

17 Claims, 6 Drawing Sheets

(56) References Cited

U.S. PATENT DOCUMENTS 1,755,696 A * 4/1930 Kluge ..... G04B 19/2538 40/115
3,841,084 A * 10/1974 Eumier ..... G04B 19/2538 368/37
4,427,300 A * 1/1984 Groothuis ..... G04B 27/005 368/28
4,464,058 A * 8/1984 Weller ..... G04B 19/223 368/21
4,674,889 A * 6/1987 Klaus ..... G04B 19/268 368/15
5,432,759 A * 7/1995 Vaucher ..... G04B 19/25 368/28
7,307,917 B2 * 12/2007 Meylan ..... G04B 19/24 368/28
9,690,257 B2 * 6/2017 Papi ..... G04B 19/241
9,703,262 B2 * 7/2017 Papi ..... G04B 19/2538
2003/0151981 A1 * 8/2003 Vernay ..... G04B 19/2536 368/37
2005/0232085 A1 * 10/2005 Scheufele ..... G04B 19/2538 368/37
2006/0215497 A1 * 9/2006 Schneider ..... G04B 19/253 368/35
2010/0135125 A1 * 6/2010 Watanabe ..... G04B 19/2536 368/37
2014/0301171 A1 * 10/2014 Forsey ..... G04B 19/02 368/37
2018/0017942 A1 * 1/2018 Dauby ..... G04B 19/025
2019/0179266 A1 * 6/2019 Kissling ..... G04B 21/04
2020/0249627 A1 * 8/2020 Papi ..... G04B 19/241

FOREIGN PATENT DOCUMENTS

EP 1351104 10/2003
EP 1818738 8/2007
EP 2490084 8/2012
GB 265779 A * 2/1927 ..... G04B 19/2538

* cited by examiner

CALENDAR MECHANISM FOR A TIMEPIECE

CROSS-REFERENCE TO RELATED APPLICATIONS

This application is a § 371 national stage entry of International Application No. PCT/EP2016/077398, filed Nov. 11, 2016, which claims priority to Swiss European Patent Application No. 01656/15, filed Nov. 13, 2015, the entire contents of which are incorporated herein by reference.

TECHNICAL FIELD

The present invention relates to the field of horology. It more particularly relates to a calendar mechanism suitable for indicating information having a period varying based on at least a first cycle and a second cycle, such as a perpetual calendar.

BACKGROUND OF THE INVENTION

Document EP 1,351,104 describes a perpetual calendar mechanism: This calendar comprises a maximum month length of 31 days, which varies over a first cycle of 12 months, and which comprises the sequence of 31-28-31-30-31-30-31-31-30-31-30-31 days per month. A second cycle of 4 years for the Julian leap year is superimposed on this first cycle, which adds one additional day to the month of February. The retractable tooth carried by a sliding lever interacts with a 24-hour wheel at the end of the month of February in non-leap years in order to advance the indication of the date from an indication of 28 directly to an indication of 1 of the following month. This tooth is retracted during leap years so that the indication can show February 29, before being advanced to 1, 24 hours later. Nevertheless, this mechanism is complex and fragile.

Document EP 1,818,738 also incorporates a third cycle of 100 years, in order to eliminate February 29th for years divisible by 100, and a fourth cycle of 400 years in order to reestablish it for years divisible by 400. This mechanism therefore makes it possible to display the entire cycle of the Gregorian calendar.

Document EP 0,606,576 describes a Muslim calendar mechanism. The Muslim calendar is based on the lunar cycle, and comprises a first cycle of 12 months, the odd months comprising 30 days, and the even months comprising 29 days. In order to compensate for the difference between this cycle and the full Muslim year, the twelfth month of certain years has 30 days instead of 29, according to a second 30-year cycle. Several variants of this second cycle exist, but one variant commonly used defines the years in which the twelfth month comprises 30 days instead of 29 as follows: $2^{nd}$, $5^{th}$, $7^{th}$, $10^{th}$, $13^{th}$, $15^{th}$, $18^{th}$, $21^{st}$, $24^{th}$, $26^{th}$ and $29^{th}$.

These calendar mechanisms of the prior art are relatively complex, and require a large amount of space in the movement.

The aim of the present invention is to propose such a calendar mechanism that is simple, compact and reliable.

BRIEF DESCRIPTION OF THE INVENTION

More specifically, the invention relates to a calendar mechanism for a timepiece, said calendar mechanism being adapted to indicate information having a period varying according to at least a first cycle and a second cycle. "First cycle" for example refers to a month cycle whereof the number of days of each month is invariable from one year to the next, for example from the first to the eleventh month of the Islamic calendar, or the months of January and March to December of the Western calendar (Julian or Gregorian). "Second cycle" for example refers to a cycle with a length different from the first, for example the 30-year cycle that determines the number of days in the twelfth month of the Islamic calendar, the four-year cycle of the Julian calendar or the 400-year cycle of the Gregorian calendar, which determines the number of days in the month of February. These two cycles are superimposed in order to provide the desired indications over a full cycle.

This mechanism comprises a months wheel comprising a gear having a number of fixed teeth, said number being chosen based on the maximum period of the information to be displayed. Normally, this number of teeth is the same as the maximum number of days in a month, or its whole multiple.

The wheel further comprises a lever arranged to move between an inactive position and an active position and vice versa, this lever being provided with at least one tooth which is retractable relative to the perimeter of the wheel. This at least one tooth can be a traditional tooth extending in the plane of the lever, or a tooth extending perpendicular to this plane in the form of a contrate tooth, pin, lug or the like, which are typically all considered "teeth" when they perform the same function.

The mechanism further comprises a driving wheel comprising a first driving organ arranged to interact with said fixed teeth and a second driving organ angularly offset relative to the first driving organ and arranged to interact with said retractable tooth when said lever is in its active position. In this position, the retractable teeth are positioned so as to be able to cooperate with the driving wheel.

Incorporated into said mechanism are a first cam whose shape represents the variations of said period according to the first cycle, and a second cam whose shape represents the variations of said period according to the second cycle, as well as an indexing system kinematically connected with said wheel, with said first cam and with said second cam and suitable for indexing each of said cams as a function of said cycles.

An actuating system of said lever is also incorporated into said mechanism. This actuating system comprises a first cam feeler-spindle intended to come into contact with the first cam and a second cam feeler-spindle intended to come into contact with the second cam, said feeler-spindles being kinematically connected to each other and the actuating system being arranged to cause said lever to move from its inactive position to its active position under the control of each of said cams.

Consequently, these two kinematically-connected feeler-spindles allow the lever to be actuated either based on information carried by the first cam, or based on information carried by the second cam, such that it is commanded based on the superposition of the two cycles in order to display the desired complete cycle, and consequently the months wheel is advanced by the appropriate number of steps at the end of each month.

Advantageously, said first cam and said second cam are each coaxial to said gear and carried by the latter. This results in a particularly compact construction. Alternatively, these two cams could also not be coaxial to said gear.

Each of said cams can be situated on the same side of said gear, or one on a first side of said gear, and the other on the opposite side.

In this second case, the second feeler-spindle advantageously extends through an opening formed in said gear in order to be able to feel the cam that is situated on the side opposite the first feeler-spindle.

Advantageously, the actuating system comprises a first lever provided with said first feeler-spindle and also provided with a stop intended to come into contact with said lever in order to cause it to go to its active position under the control of said first cam.

In one variant, not only the first feeler-spindle, but also the second feeler-spindle is carried by the first lever, which creates a particularly compact arrangement. Alternatively, the actuating system can comprise a second lever kinematically connected with said first lever, said second lever bearing said second feeler-spindle.

In one variant, the actuating system comprises an additional actuating wheel kinematically connected, directly or indirectly, with said first lever. This additional actuating wheel is arranged to cause said lever to move toward its active position under the control of said second cam.

Advantageously, the additional actuating wheel is pivoted relative to said gear and comprises an additional actuating cam intended to press against said lever under the control of said second cam.

In one variant, said first cam has a shape representative of the number of days in a month varying according to a first cycle, and said second cam has a shape representative of the number of days in at least one particular month that varies according to a second cycle, and in which said first cam comprises a notch representative of at least one month whose number of days is determined according to said second cycle. In one particular alternative in which the first cycle comprises twelve months and the second cycle comprises thirty years, the shape of said first cam represents the number of days from the first to the eleventh month varying according to the first twelve-month cycle, the notch corresponding to the twelfth month, and the shape of said second cam corresponds to the number of days of the twelfth month varying over the second thirty-year cycle. The notch allows the first cam not to influence the position of the first lever for the month where the number of days is determined by the second cam.

Alternatively, the first cycle comprises four years, the shape of said first cam representing the number of days in February varying according to the first four-year cycle (i.e., 28-28-28, then 28 or 29 (depending on the second cycle)), the notch corresponding to the month of February, which may or may not be a leap year for example depending on the Julian or Gregorian calendar. In this alternative, the second cycle comprises 100 years or 400 years, the shape of said at least one cam representing the number of days in February for years divisible by four, which may or may not be leap years depending on the Gregorian or Julian cycle.

Advantageously, the mechanism comprises a second additional cam superimposed on said second cam, the combination of the second cam and the additional second cam defining a 400-year cycle, particularly according to the Gregorian calendar. This makes it possible to avoid using a single cam with 400 sectors, and to use to simpler, superimposed cams. In order to read these cams, the second feeler-spindle can be arranged to feel the second cam and the additional second cam in parallel, i.e., simultaneously.

Advantageously, said lever carries at least two retractable teeth having the same separation as two fixed teeth of the gear. The mechanism is therefore reversible, and maintains its indexing independently of the rotation direction of the driving wheel. Consequently, even when a correction is made in the direction opposite the normal operating direction, correct indexing is therefore provided.

Advantageously, a device for displaying the day of the week can be provided, which is preferably associated with the driving wheel in order to indicate the day of the week simply.

BRIEF DESCRIPTION OF THE DRAWINGS

Other details of the invention will appear more clearly upon reading the following description, done in reference to the appended drawings, in which.

DETAILED DESCRIPTION OF THE INVENTION

Figure 2:
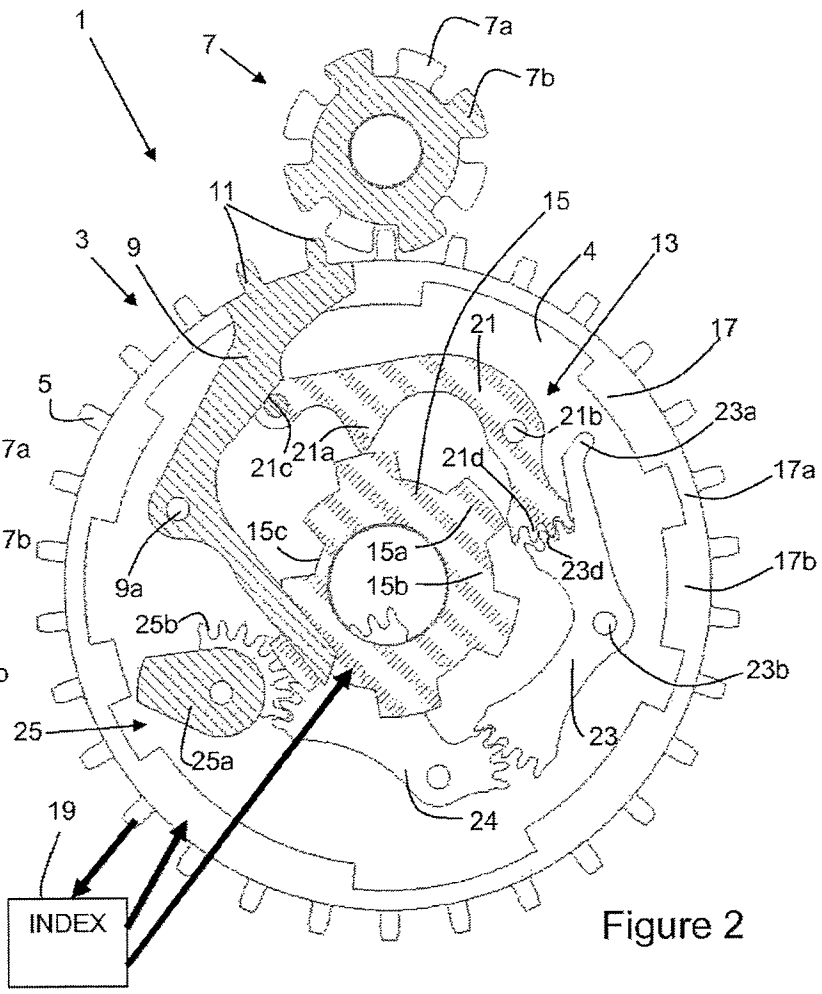
FIGS. 1-3 are top views of a first embodiment of a calendar mechanism according to the invention in different positions.
Figure 1:
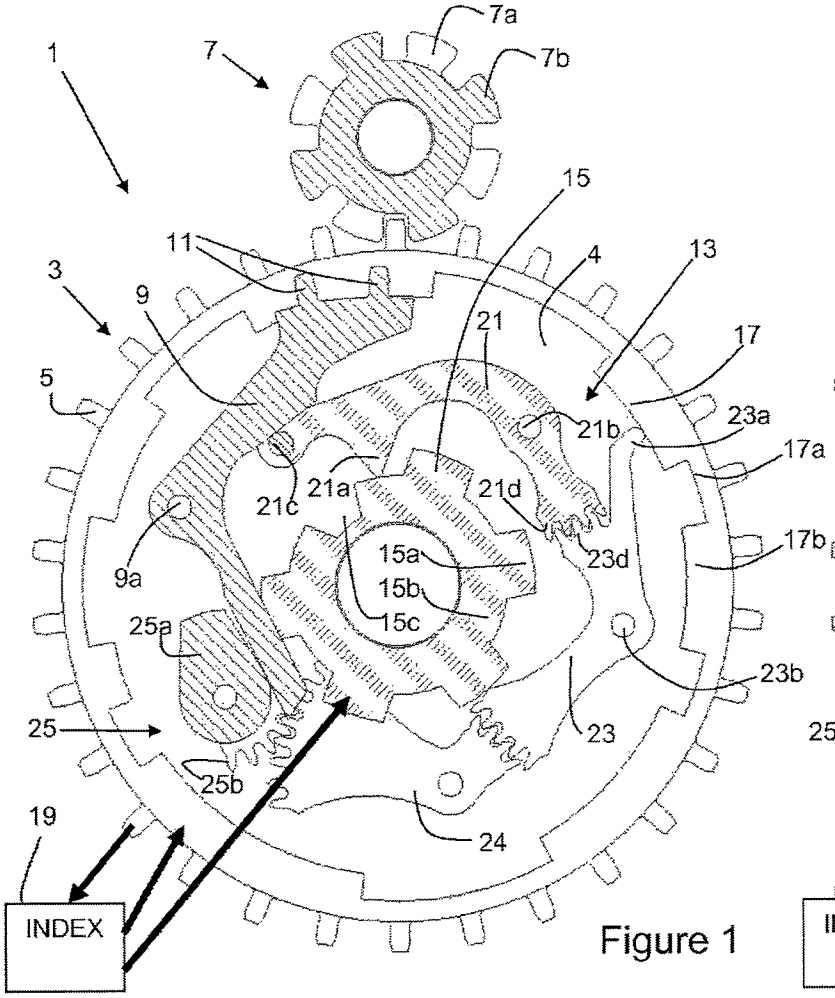
Figure 4:
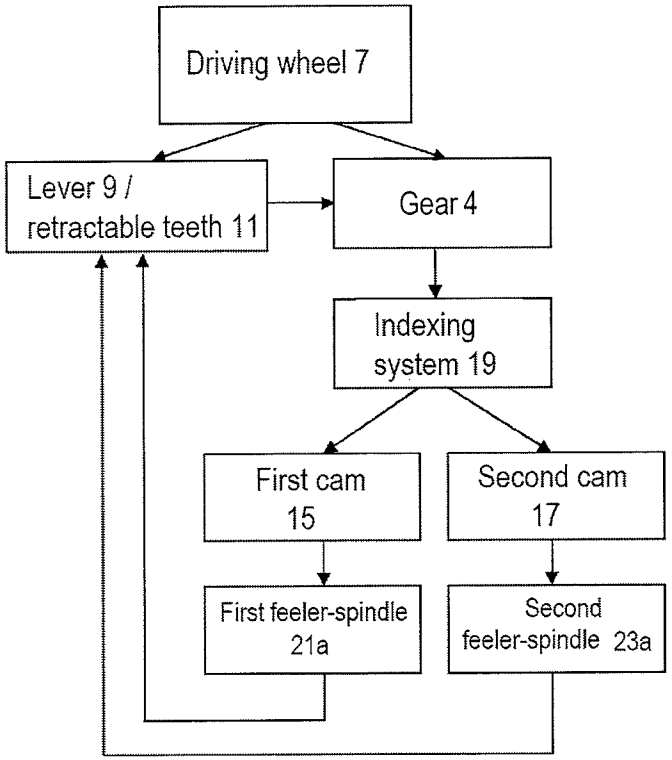
FIG. 4 is a schematic diagram illustrating the operating principle of the calendar mechanism according to the invention.
Figure 3:
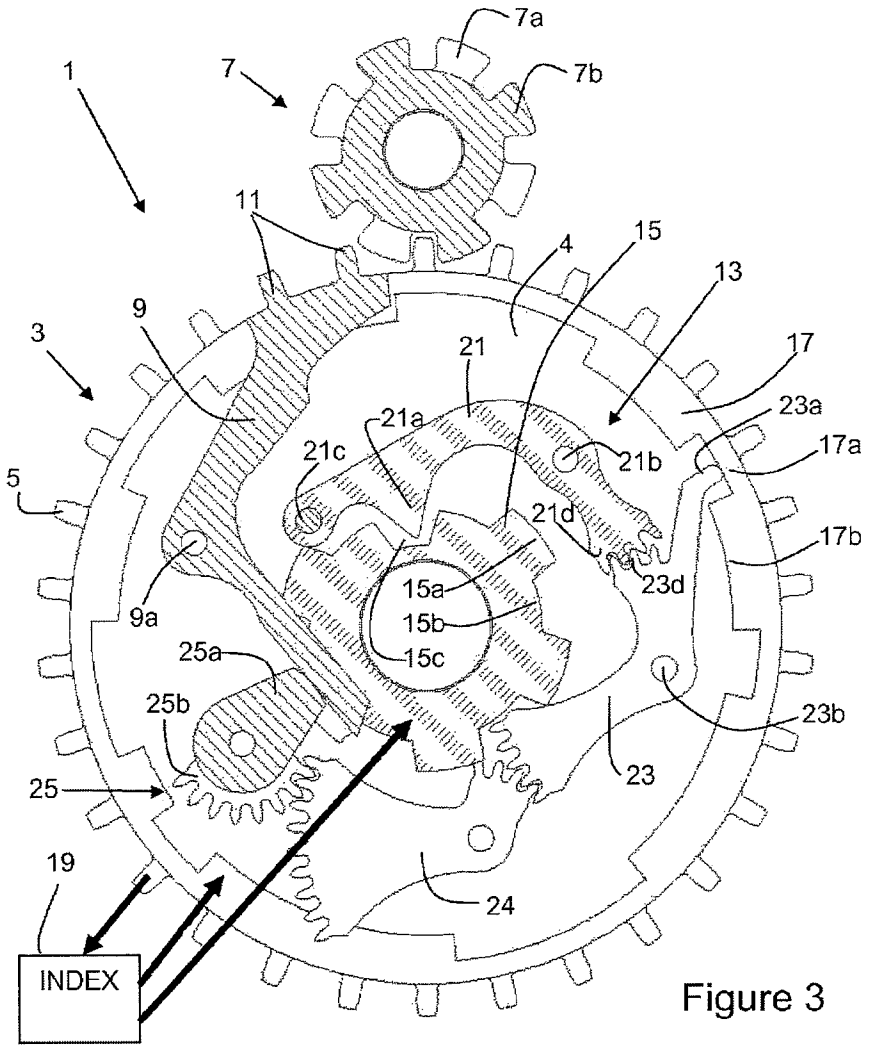

FIGS. 1-3 schematically illustrate one embodiment of a calendar mechanism 1 according to the invention, in the form of a Muslim calendar. In order to illustrate the interaction between the various components and to provide a better appreciation of depth in the figures, different types of cross-hatching have been used. Furthermore, FIG. 4 illustrates the operating principle in the form of a schematic.

The mechanism 1 comprises a months wheel 3, which comprises a gear 4 bearing fixed teeth 5 relative to the wheel 4. The number of fixed teeth 5 is chosen based on the maximum number of days to be displayed, in particular thirty in the illustrated case. A whole multiple of this number is also possible. The positioning of the months wheel 3 can be provided traditionally using a jumper (not illustrated). The gear 4 is traditionally associated with one (or several) display organ(s) (not illustrated) that indicate(s) the date.

The months wheel 3 is driven by a driving wheel 7, which comprises a first driving organ 7*a* provided with four driving teeth or fingers separated by spaces, these latter being configured in order to cooperate with the fixed teeth 5. The driving wheel 7 is in turn arranged to cooperate with the fixed teeth 5. The driving wheel 7 in turn is arranged to be driven by a base movement (not illustrated) at a rate of one quarter-revolution per 24 hours, typically around midnight. The number of driving teeth or fingers can be chosen based on the horologist's needs, and considered generically, if n is the number of driving teeth or fingers, the driving wheel 7 performs 1/n revolutions per day.

The months wheel 3 also comprises a lever 9, pivoted on the gear 4 at a pivot point 9*a*, which carries retractable teeth 11 situated in a plane different from that of the fixed teeth 5 and secured with the lever 9. In the view of FIG. 1, the lever 9 and the retractable teeth 11 are in their—inactive—retracted position, while they are in their—active—deployed position in FIGS. 2 and 3. A return spring (not shown) acts to keep the lever 9 in its inactive position (FIG. 1). In the active position of the lever 9, the retractable teeth 11 can cooperate with a second driving organ 7*b* comprised by the driving wheel 7. The retractable teeth 11 are therefore retractable relative to the perimeter of the months wheel 3.

This second driving organ 7*b* has a shape substantially similar to the first driving organ 7*a*, but is angularly offset by ⅛ revolution relative to the latter and is situated in a plane allowing it to cooperate with the retractable teeth 11.

Consequently, if the retractable teeth 11 are in their retracted position (FIG. 1), the second driving organ 7*b* has no effect, and for each quarter-revolution of the driving wheel 7, the months wheel 3 is pivoted by one step, namely by one tooth in the illustrated case.

If the retractable teeth 11 are in their active position (FIGS. 2 and 3), a quarter-revolution of the driving wheel 7 pivots the months wheel 3 by one step by means of the interaction between the first driving organ 7*a* and the fixed teeth 5, and an additional step by means of the interaction between the second driving organ 7*b* and the retractable teeth 11.

If the retractable teeth 11 only comprise one tooth 11, the calendar mechanism 1 only works in a single rotation direction. However, in the illustrated case where two retractable teeth 11 are present and each superimposed on a pair of fixed teeth of the gear 4 (or are offset by one pair of fixed teeth of the gear 4), with a separation similar or identical to the separation between two fixed teeth 5 of the gear 4, the calendar mechanism 1 works reversibly, i.e., the number of steps performed by the months wheel 3 after driving in either direction (for example after a manual correction of the date in the direction opposite the typical rotation direction of the months wheel 3) remains correct, and the mechanism always remains correctly indexed relative to the displayed date by means of indicator organs associated therewith (not illustrated). If the gear 4 comprises a number of fixed teeth 5 that is a multiple of the maximum number of days in a month, the number of retractable teeth can be multiplied by this multiple.

The position of the lever 9 is controlled by means of an actuating system 13 based on the position of a first cam 15 and a second cam 17. The first cam 15 is situated between the pivot point 9*a* of the lever 9 and the rotation axis of the wheel 3, and is arranged to pivot relative to the gear 4. The shape of the first cam represents the first 12-month cycle, and therefore has larger radius parts 15*a* representing the odd months with 29 days, and smaller radius parts 15*b* representing the even months with 30 days. Given that the number of days of the twelfth month depends on the year, this month is represented by a notch 15*c* whose operation will appear more clearly hereinafter.

The second cam 17 is situated between the pivot point 9*a* of the lever 9 and the periphery of the gear 4, and is also arranged to pivot relative to the gear 4. The shape of the second cam 17 represents the second 30-year cycle, which determines the number of days of the twelfth month. The shape of the cam 17 extends inward, and comprises larger radius parts 17*a*, which represent the twelfth months with 29 days, and smaller radius parts 17*b*, which represent the twelfth months with 30 days.

This type of cam is often called "programme cam", because their shape determines the number of days indicated in a month, and therefore serves to "programme" the sequence indicated by the mechanism 1.

The cams 15, 17 are supported and rotated relative to the gear 4 using an indexing system 19, which is shown schematically in FIGS. 1 to 3, and ensures that the angular position of each cam 15, 17 relative to the gear 4 is correctly indexed for the indicated date. As shown by the arrows, the indexing system 19 is driven by the gear 4, and drives the two cams 15, 17 by means of an appropriate transmission system, such as gears, a Maltese cross, star or any other appropriate system. It goes without saying that this transmission system can control the two cams 15, 17 individually, or can control the second cam 17 relative to the first 15. The details of the indexing system are not part of the invention in itself, and will not be described in more detail.

The actuating system 13 comprises a first lever 21 bearing a feeler-spindle 21*a*, the first lever being pivoted on the gear 4 at a pivot point 21*b* under the effect of a spring (not shown). The first lever 21 also bears a stop formed by a stud 21*c* arranged to press against a flank of the lever 9 in order to bring the latter into its active position (FIG. 2). However, said first lever 21 could also work directly with said lever 9 without using a stud. Likewise, the lever 9 could include a stud and the first lever 21 could not have one. It is also possible for the lever 9 and the first lever 21 each to have a stud.

The first feeler-spindle 21*a* follows the first cam 15 such that, when the first feeler-spindle 21*a* is in contact with a smaller radius portion 15*b* of the latter (FIG. 1), the stud 21*c* does not bring the lever 9 into its active position, and the retractable teeth 11 are in their retracted position, the second driving organ 7*b* cannot interact with the retractable teeth 11, and a 30-day cycle will therefore be displayed.

However, when the first feeler-spindle 21*a* is in contact with a larger radius portion 15*a* of the first cam (FIG. 2), the stud 21*c* brings the lever 9 and the retractable teeth 11 into their active positions. Consequently, the second driving organ 7*b* can interact with the retractable teeth 11, and a 29-day cycle will therefore be displayed because the gear 4 will advance at a rate of two steps at the end of the month.

During the twelfth month, the first feeler-spindle 21*a* is in the notch 15*c*, and consequently the stud 21*c* is situated away from the lever 9. The length of the twelfth month is determined not by the first cam 15, by the second cam 17.

In order to feel the second cam 17, a second lever 23 is also pivoted on the gear 4 at a pivot point 23*b*, and is kinematically connected with the first lever 21 using complementary toothed segments 21*d*, 23*d* carried by each lever 21, 23. The second lever 23 comprises a second feeler-spindle 23*a*, which is intended to come into contact with the second cam 17, at least during the twelfth month. If the twelfth month has 30 days, the second feeler-spindle 23*a* is in contact with a smaller radius part of the second cam 17, and the actuating device 13 adopts the configuration illustrated in FIG. 1, with the exception of the fact that the first feeler-spindle 21*a* is across from the notch 15*c*.

If the twelfth month comprises 29 days, the second feeler-spindle 23*a* is across from a larger radius part 17*a* of the second cam 17, as illustrated in FIG. 3. The first feeler-spindle 21*a* being across from the notch 15*c*, it can therefore pivot further toward the rotation axis of the first cam 15 than in the other positions of the first cam 15. The second feeler-spindle 23*a* is therefore free to come into contact with, and be placed against, the larger radius part 17*a* of the second cam 17, which causes the second lever 23 to pivot clockwise (relative to the view of FIGS. 1 to 3). This rotation is transmitted to an additional actuating wheel 25 pivoted on the gear 4 and made up of an additional actuating cam 25*a* arranged to command the lever 9, as well as a gear wheel 25*b* that is kinematically connected with the second feeler spindle 23*a* by means of a transmission lever 24. In the illustrated case, the transmission lever 24 also comprises two toothed segments, or racks, meshing on either side with said toothed wheel 25*b* and with a complementary toothed sector comprised by the second lever 25.

It goes without saying that any type of kinematic link between the levers 21, 23, 24 and the additional actuating wheel 25 is possible, for example studs cooperating with grooves, a belt or the like.

Indeed, the mechanism represents a globally binary logic system, which can be shown by the following transfer table:

| Cam 1 | Cam 2 | Lever 9 |
|---|---|---|
| 0 (smaller radius) | 0 (smaller radius) | 0 (retracted; 30 days) |
| 0 | 1 (larger radius) | 0 |
| 1 (larger radius) | 0 | 1 (active; 29 days) |
| 1 | 1 | 1 (active; 29 days) |
| X (notch) | 0 | 0 |
| X | 1 | 1 (active; 29 days) |

It is clear that the cam 1 has "priority" in this logic, and that it is only when the first feeler-spindle 21*a* is across from the notch 15*c* that the cam 2 can influence the position of the lever 9.

In order to avoid conflicts between the various components of the mechanism 1, they are located in appropriate planes so that they can pass above one another as needed. For example, in FIG. 1, the transmission lever 24 is overlapped by the first cam 15, which is therefore located in another plane. The same situation also exists with the second cam 17, which is overlapped by the transmission lever 24 in FIG. 3.

FIG. 4 schematically illustrates the operating principle of the mechanism 1 according to the invention. The driving wheel 7 drives the gear 4 around midnight as well as driving, if applicable, the retractable teeth 11. The retractable teeth 11 are in their active position and are therefore driven by the second driving organ 7*b*, the force exerted on the lever driving the gear 4 by one additional step.

The gear 4 being kinematically connected with the indexing system 19, each modification of the angular position of the months wheel 3 modifies the state of the indexing system, which modifies the position of the first cam 15 and the second cam 17 so that they are indexed correctly relative to the gear 4 for the displayed date. These cams 15, 17 are felt by the first and second feeler-spindles 21*a*, 23*a*, respectively, which therefore determine the position of the lever 9.

FIGS. 5 to 8 illustrate a second embodiment of a Muslim calendar mechanism 1 that applies the same principle as that of FIGS. 1 to 3. These figures illustrate the mechanism 1, seen from both sides, in particular the upper side (FIGS. 5 and 6) and lower side (FIGS. 7 and 8), and in perspective (FIGS. 5 and 7) and in plan (FIGS. 6 and 8) views, during a 30-day month. In these figures, the driving wheel 7 has not been shown, but may be identical to that illustrated in FIGS. 1 to 3 or have any other appropriate form.

This embodiment primarily differs from the first in the positioning of the second cam 17 and the components of the actuating system 13.

Figure 6:
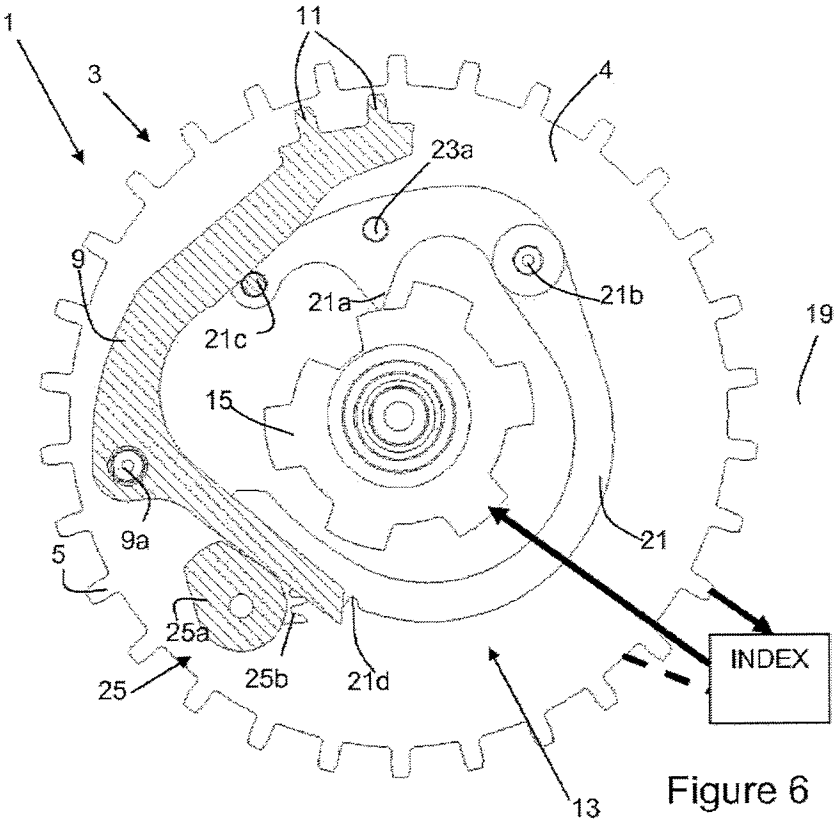
FIGS. 5-8 are perspective and planar views of a second embodiment, seen from two sides of the mechanism.
Figure 5:
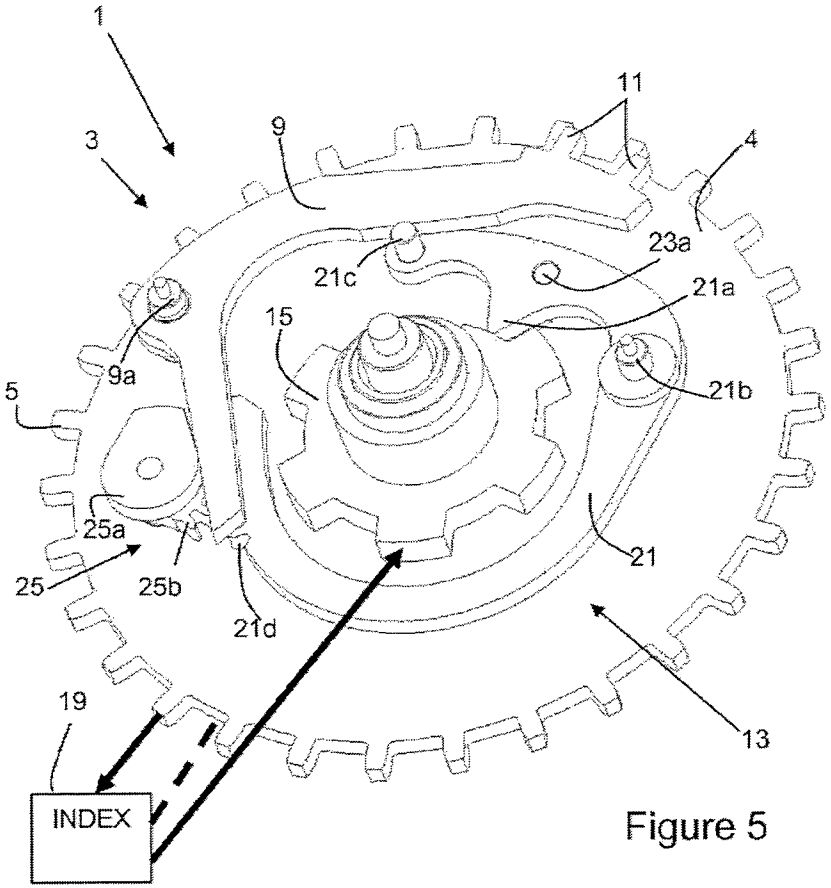
Figure 8:
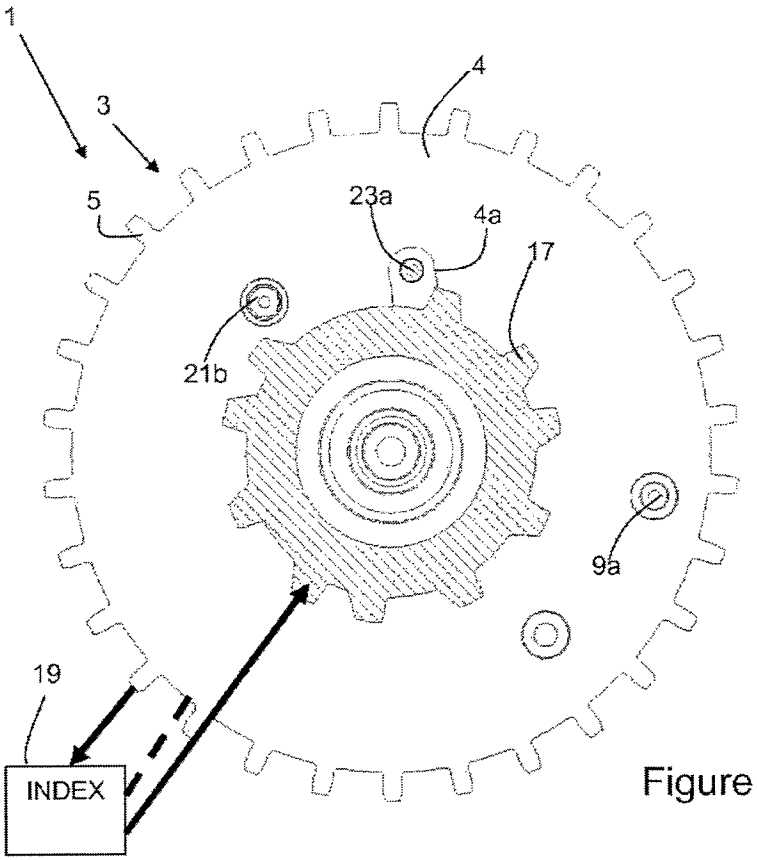
Figure 7:
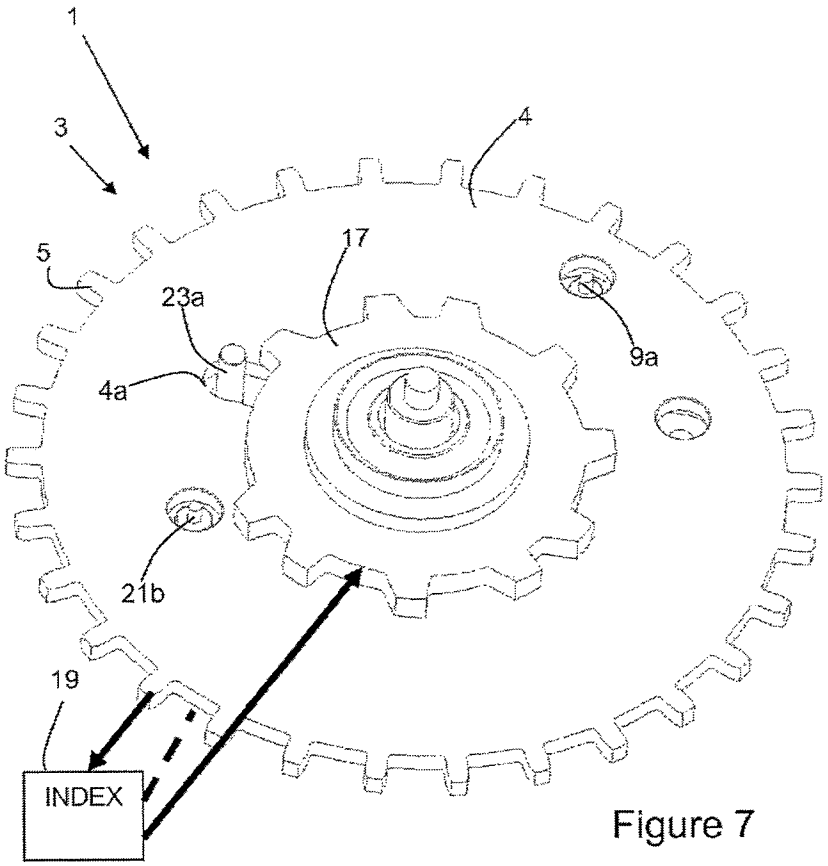

As visible in FIGS. 5 and 6, the arrangement of the lever 9, the first cam 15, the first feeler-spindle 21*a* and the stud 21*c* is substantially unchanged.

However, the first lever 21 extends in a curve so that its rack 21*d* meshes directly with the toothed sector 25*b* of the additional actuating wheel 25. Consequently, the intermediate levers 23 and 24 of the first embodiment have been deleted.

Nevertheless, it goes without saying that a different kinematic link between the first lever 21 and the additional actuating wheel is also possible.

The second cam 17 is on the opposite side of the gear 4, therefore on the face other than that of the first cam 15, and is situated centrally, extending outward. The second feeler-spindle 23*a* is a pin secured to the first lever 21, which extends through an opening 4*a* formed in the gear 4 so as to be able to feel the second cam 17.

Notwithstanding the structural changes, the operating principle of the mechanism remains unchanged.

Figure 9:
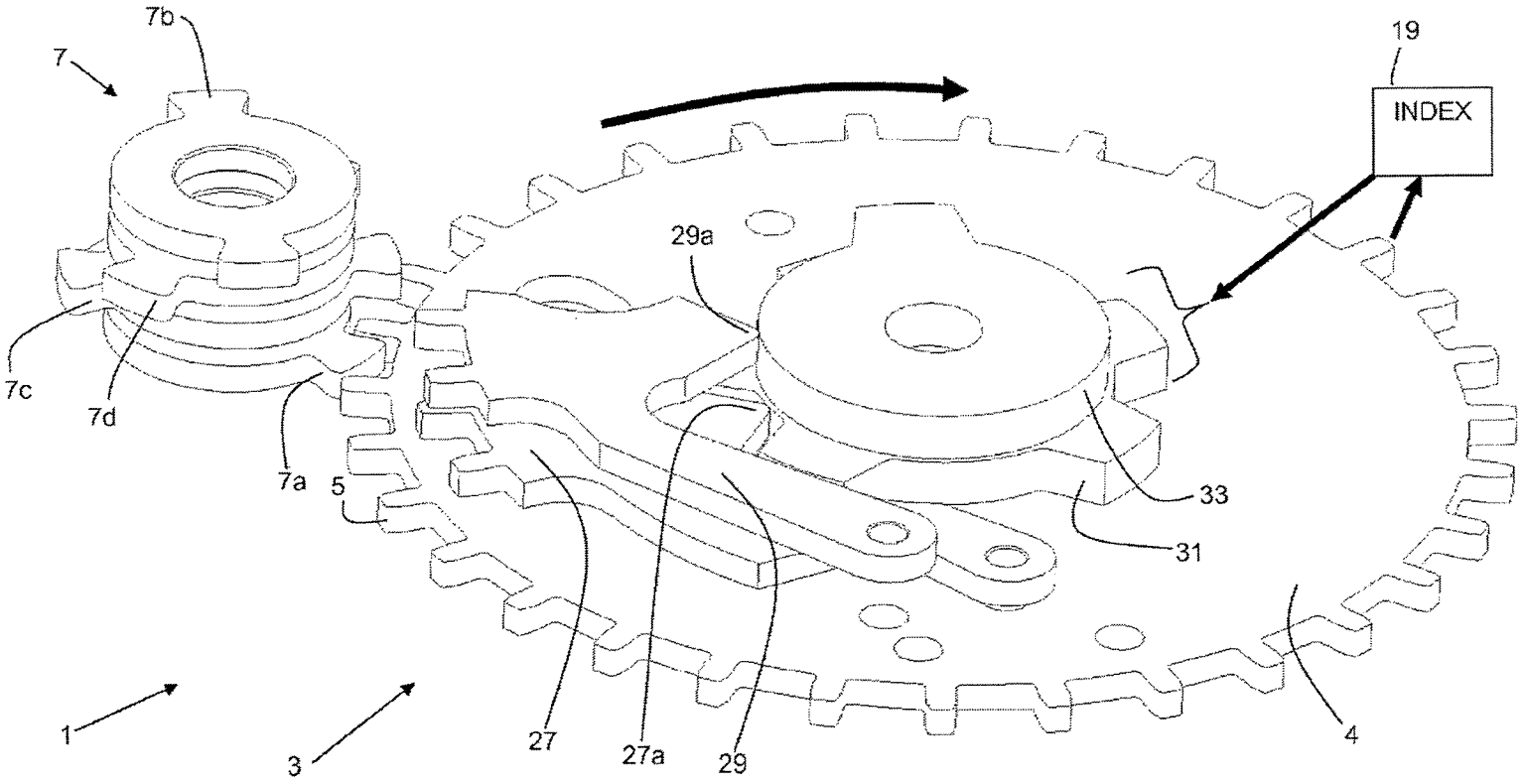
FIGS. 9-11 are perspective views of a third embodiment, seen from two sides of the mechanism.
Figure 11:
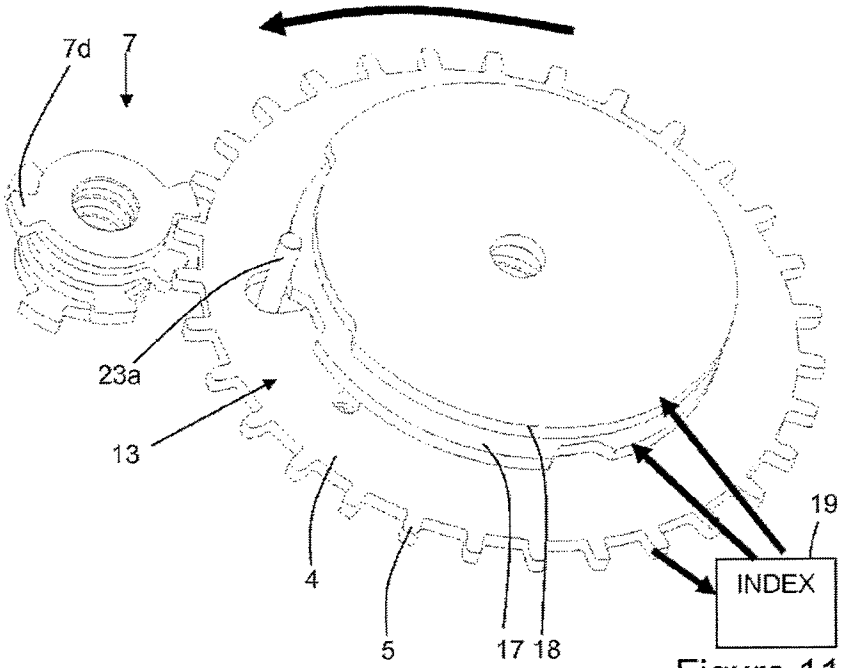
Figure 10:
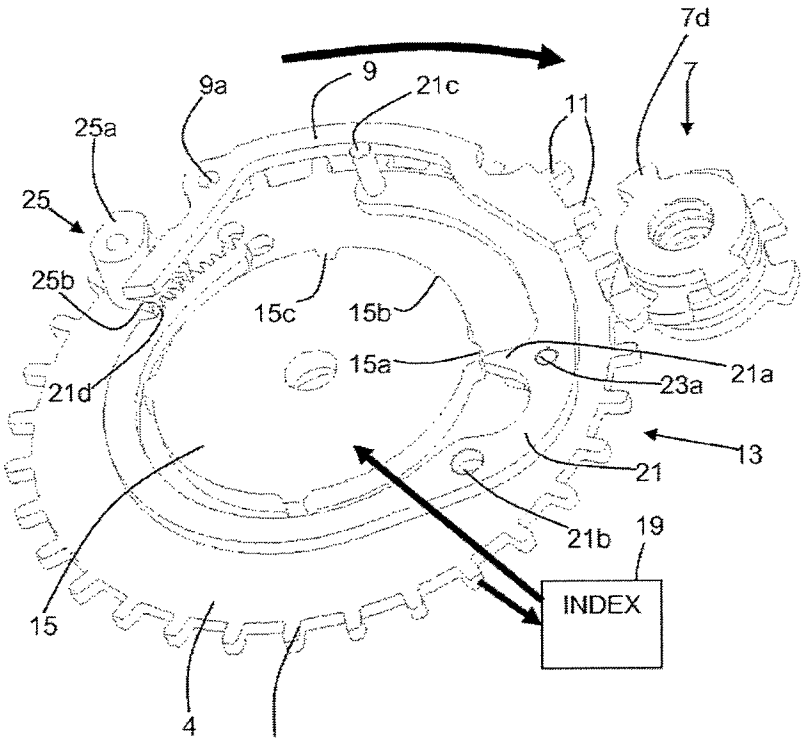

FIGS. 9 to 11 illustrate the same operating principle as described above, but applied to the handling of the month of February of the Gregorian calendar. This system being more complicated than those described above, certain assembly elements (staffs, pins, etc.) have not been illustrated. Furthermore, the illustration is highly schematic in order to more clearly show its operation, and the elements dealing with the jumps for days 31 and 30 of the month have been shown separately from those dealing with the jump for day 29 of the month, in different figures.

FIG. 9 illustrates the elements providing the jump for the $31^{st}$ day of the month during months with 30 days as well as each month of February, and the jump for the 30th day of the month at the end of each February. These jumps follow a single 12-month cycle, and consequently do not apply the principle of superimposed cycles according to the invention, but are illustrated here in the interest of completeness.

In this embodiment, the gear 4 of the months wheel 1 comprises 31 teeth (or alternatively a whole multiple of 31 teeth) that cooperates with a first driving organ 7*a* of the driving wheel 7, and during its standard operation, rotates clockwise as seen in FIG. 9 at a rate of one revolution per month. The first additional lever 27 is pivoted on the gear 4 (its axis having been removed from the figure), and has two teeth arranged similarly to those of the lever 9 mentioned above and which are positioned so as to be able to interact with an additional driving organ 7*c* of the driving wheel 7, situated in a plane other than that of the first driving organ. A second additional lever 29 is also pivoted on the gear 4 (its axis also having been removed from the figure), and also has two teeth offset by one step in the upstream direction relative to those of the first additional lever 27, and which are positioned in order to be able to interact with still another additional driving organ 7*d* situated in still another different plane on the driving wheel. These additional levers 27, 29 operate in a manner similar to the lever 9, except that they are each controlled by a single cam. Furthermore, in the illustrated embodiment, the driving organs are provided in pairs, offset by 180°. The driving wheel therefore performs a half-revolution per day. Other arrangements are also possible, for example 1, 3 or 4 driving organs per level.

The actuation of these levers being carried out according to a single 12-month cycle, the wheel 3 comprises a first additional cam 31, which is followed by a feeler-spindle 27*a* of the first additional lever 27 in order to bring this lever into its active position at the end of months with 28, 29 or 30 days. This additional cam 31 therefore has five protrusions corresponding to the months with fewer than 31 days. A second additional cam 33, secured in rotation with the first additional cam 31, is also followed by a feeler-spindle 29*a* of the second additional lever 28 in order to bring this lever into its active position each February, and to that end this additional cam 31 has a protrusion corresponding to the month of February.

The indexing system 19 provides the angular relationship between the additional cams 31, 33 and the gear 4, while providing a rotation speed ratio of 11/12 or 13/12 of the additional cams 31, 33 relative to the gear 4, in the desired direction of relative rotation between these components.

However, any other speed ratio between the gear 4 and the cam 31 as well as between the gear 4 and the cam 33 can be considered, as long as the teeth of the levers 27 and 29 are positioned appropriately during their passage in front of the driving wheel 7.

FIGS. 10 and 11 illustrate the elements that relate to the month of February. The illustrated arrangement shows a modification of the system of FIGS. 5 to 8, and consequently, only the differences with respect to the embodiment of the latter figures will be described in detail here, the elements having the same reference signs reprising the same functions, mutatis mutandis.

The first cam 15, the lever 9 (the rotation axis 9*a* of which has not been shown), and the components of the actuating system 13 visible in FIG. 10 are superimposed on the additional levers 27, 29 and the additional cams 31, 33 such that the teeth 11 of the lever 9 can interact with the second driving organ 7*b* of the driving wheel 7.

The first cam 15 in fact comprises 48 sectors representing the first cycle of 4 years/48 months, most of these sectors of which have the same, smaller, radius 15*b* (months other than February). The three larger radius parts 15*a* are bosses representing the months of February which are always non-leap years and which bring the lever 9 into its active position in order to jump over the 29th of the month, and a notch 15*c* represents those of a year that may optionally be a leap year (and therefore comprise 29 days) according to the Gregorian calendar (i.e., each year divisible by 4). The indexing system makes sure that the first cam 15 performs a quarter-revolution per year relative to the gear 4.

In the same way as for the embodiment of FIGS. 5 to 8, this notch delegates the control of the lever 9 to at least a second cam 17, located on the opposite side of the gear 4. In this case, the mechanism comprises not only a second cam 17, but also an additional second cam 18 coaxial to the second. These two cams are felt in parallel by the second feeler-spindle 23*a*. In the illustrated embodiment, the second cam 17 comprises twenty sectors, three of which have notches, and the second additional cam 18 comprises five sectors, one of which has a notch. In effect, the combination of these notches provides the information on whether the year in question is divisible by 100 and not by 400.

Looking at FIG. 11, one sees the second cam 17, which for example performs one revolution in 400 years relative to the gear 4, and the second additional cam 18, which performs one revolution in 20 years, also relative to the same gear. Alternatively, the second cam 17 can for example also perform one revolution in 80 years, and the additional second cam 18 can perform one revolution in 400 years. A single second cam 17 having 400 sectors is in fact very difficult to produce in light of the size of such a mechanism, which is why it has been chosen to use the "AND" logic combination of two cams 17, 18. This combined cycle of 400 years is therefore the second cycle within the meaning of the invention.

Consequently, if a notch of the second cam 17 and a notch of the additional second cam 18 are located below the second feeler-spindle 23*a* (which is the case for each year divisible by 100, but not by 400), the latter falls into the combined notch (as long as the feeler-spindle 21*a*, which is located on the opposite side of the gear 4, is above the notch 15*c*), and the first lever 21 pivots in the counterclockwise direction according to the view of FIG. 10. Its rack 21*d* therefore controls the additional actuating cam 25*a* to bring the retractable teeth 11 into their active position, and the 29th day of the month is thus jumped over for the years 1700, 1800, 1900, but not for 1600, 2000, etc. For any other month of February, the year is a leap year and at least one of the second cam 17 and the additional second cam 18 prevents the first lever 21 from rotating and the retractable teeth 11 remain in their inactive position. Consequently, the 29th day of the month is not jumped over and is therefore displayed. Such a configuration is illustrated in FIG. 11.

This system is also completely reversible and maintains its indexing during a backward correction by means of the driving wheel.

However, the illustrated embodiment is not limiting, and depending on the arrangement, the sizing and the nature of the driving means of the cams 17, 18, any other appropriate speed ratio between the latter can be considered and is covered by the present invention, as long as the teeth 11 of the lever 9 are positioned appropriately during their passage in front of the driving wheel 7. The important point is that, during the month of February in leap years (therefore when the feeler-spindle 21*a* has the possibility of falling into the notch 15*c*) and when the teeth 11 are close to the driving wheel 7, the cams 17 and 18 are positioned correctly.

In all of the embodiments, it is also possible to provide a device for displaying any day of the week, which may be associated with the driving wheel 7.

Although the invention has been described in reference to several specific embodiments, changes are possible without going beyond the scope of the invention, as defined by the claims. In particular, it should be noted that the same principle may also be applied to a Gregorian, annual or Julian Western, Chinese, Hebrew or similar calendar.

The invention claimed is:

1. A calendar mechanism (1) for a timepiece, said calendar mechanism (1) being adapted to indicate information having a period varying according to at least a first cycle and a second cycle, said mechanism (1) comprising:

a months wheel (3) comprising a gear (4) having a number of fixed teeth (5), said number being chosen in function of the maximum period of the information to be displayed, the wheel (3) further comprising a lever (9) arranged to move between an inactive position and an active position and being provided with at least one retractable tooth (11);

a driving wheel (7) comprising a first driving organ (7*a*) arranged to interact with said fixed teeth (5) and a second driving organ (7*b*) angularly offset relative to the first driving organ (7*a*) and arranged to interact with said retractable tooth (11) when said lever (9) is in said active position;

a first cam (15) representing the variations of said period according to the first cycle;

at least one second cam (17) representing the variations of said period according to the second cycle;

an indexing system (19) kinematically connected with said gear (4), with said first cam (15) and with said second cam (17) and adapted to index each of said cams (15, 17) relative to said gear (4) as a function of said cycles;

an actuating system (13) of said lever (9), the actuating system (13) comprising a first cam feeler-spindle (21*a*) intended to come into contact with the first cam (15) and a second cam feeler-spindle (23*a*) intended to come into contact with the second cam (17), said feeler-spindles (21*a*, 23*a*) being kinematically connected to each other and the actuating system (13) being arranged to cause said lever (9) to move from said inactive position to said active position under the control of each of said cams (15, 17).

2. The calendar mechanism (1) according to claim 1, wherein said first cam (15) and said second cam (17) are each coaxial to said gear (4) and are carried by the latter.

3. The calendar mechanism (1) according to claim 1, wherein each of said cams (15, 17) is situated on the same side of said gear (4).

4. The calendar mechanism (1) according to claim 1, wherein one of said cams (15, 17) is situated on a first side of said gear (4), and the other of said cams (17, 15) is situated on a second side of said gear (4).

5. The calendar mechanism (1) according to claim 4, wherein the second feeler-spindle (23*a*) extends through an opening (4*a*) in said gear (4).

6. The calendar mechanism (1) according to claim 1, wherein the actuating system (13) comprises a first lever (21) provided with said first feeler-spindle (21*a*), the first lever (21) also comprising a stop (21*c*) intended to come into contact with said lever (9) in order to cause said lever to go to said active position under the control of said first cam (15).

7. The calendar mechanism (1) according to claim 6, wherein the second feeler-spindle (23*a*) is carried by the first lever (21).

8. The calendar mechanism (1) according to claim 6, wherein the actuating system comprises a second lever (23) kinematically connected with said first lever (21), said second lever (23) carrying said second feeler-spindle (23*a*).

9. The calendar mechanism (1) according to claim 6, wherein the actuating system (13) comprises an additional actuating wheel (25) kinematically connected with at least said first lever (21) and arranged to cause said lever (9) to move toward said active position under the control of said second cam (17).

10. The calendar mechanism (1) according to claim 9, wherein the additional actuating wheel (25) is pivoted relative to said gear (4) and comprises an additional actuating cam (25*a*) intended to press against said lever (9) under the control of said second cam (17).

11. The calendar mechanism (1) according to claim 1, wherein said first cam (15) has a shape (15*a*, 15*b*) representative of the number of days in a month varying according to a first cycle, and said second cam (17) has a shape (17*a*, 17*b*) representative of the number of days in at least one particular month that varies according to a second cycle, and in which said first cam (15) comprises a notch (15*c*) representative of at least one month whose number of days is determined according to said second cycle.

12. The calendar mechanism (1) according to claim 11, wherein the first cycle comprises twelve months, the shape of said first cam (15) representing the number of days from the first to the eleventh month varying according to the first twelve-month cycle, the notch (15*c*) corresponding to the twelfth month, and wherein the second cycle comprises thirty years, the shape of said second cam (17) representing the number of days of the twelfth month varying over the second thirty-year cycle.

13. The calendar mechanism (1) according to claim 11, wherein the first cycle comprises four years, the shape of said first cam (15) representing the number of days in February varying according to the first four-year cycle, the notch (15*c*) corresponding to the month of February, which may or may not be a leap year, and wherein the second cycle comprises 400 years, the shape of said at least one second cam (17) representing the number of days in February for years divisible by four.

14. The calendar mechanism (1) according to claim 13, further comprising a second additional cam (18) superimposed on said second cam (17), the combination of the second cam (17) and the additional second cam (18) defining a 400-year cycle.

15. The calendar mechanism (1) according to claim 14, wherein said second feeler-spindle (23*a*) is arranged to feel the second cam (17) and the additional second cam (18) in parallel.

16. The calendar mechanism (1) according to claim 1, wherein said lever (9) carries at least two retractable teeth (11) having the same separation as two adjacent fixed teeth (5).

17. The calendar mechanism (1) according to claim 1, further comprising a device for displaying the day of the week, which is preferably associated with the driving wheel (7).

* * * * *